United States Patent [19]

Field et al.

[11] 4,136,519

[45] Jan. 30, 1979

[54] HYDRAULIC CYCLOIDAL DRIVE

[75] Inventors: Harry Field, Mt. Clemens; Monte L. Smith, St. Clair Shores; Jas. A. Whitehead, Southfield; Monroe E. Learn, Fraser, all of Mich.

[73] Assignee: Newcor, Inc., Bay City, Mich.

[21] Appl. No.: 819,153

[22] Filed: Jul. 26, 1977

[51] Int. Cl.[2] ..... F15B 15/18

[52] U.S. Cl. ..... 60/369; 60/378; 60/383; 60/433

[58] Field of Search ..... 60/369, 378, 379, 383, 60/433, 434

[56] References Cited

U.S. PATENT DOCUMENTS

| | | | |
|---|---|---|---|
| 1,660,977 | 2/1928 | Smith | 60/383 X |
| 2,391,996 | 1/1946 | Muller | 60/379 |
| 3,434,283 | 3/1969 | Piret | 60/378 |

*Primary Examiner*—Edgar W. Geoghegan
*Attorney, Agent, or Firm*—Blanchard, Flynn, Thiel, Boutell & Tanis

[57] ABSTRACT

A transfer system having a transfer mechanism which is located directly on or adjacent the production machine. The transfer mechanism comprises a reciprocating workpiece shuttle driven by a hydraulic driving unit, specifically a hydraulic transfer cylinder. The latter is connected to a remote hydraulic cycloidal drive unit by long conduits which may be positioned overhead. The remote hydraulic cycloidal drive unit employs a pumping cylinder having an elongated stationary piston rod on which the cylinder housing is slidably supported, with the pressure fluid from the pumping cylinder being supplied through the conduits to the transfer cylinder. The housing of the pumping cylinder is reciprocated by a crank associated with a cycloidal mechanical drive. This crank is connected to and rotates with a gear which is rotatably supported on a slide and reacts with a stationary rack so that reciprocation of the slide causes alternate rotation of the gear. The slide of the cycloidal mechanical drive is in turn reciprocated by a hydraulic drive cylinder which is disposed adjacent and parallel to both the pumping cylinder and the slide.

7 Claims, 4 Drawing Figures

HYDRAULIC CYCLOIDAL DRIVE

FIELD OF THE INVENTION

This invention relates to an oscillating transfer system for moving workpieces, as between adjacent work stations, and in particular relates to an improved system which utilizes a hydraulic cycloidal drive located remotely from and drivingly connected to a transfer mechanism positioned in close association with a production machine, such as a boring machine.

BACKGROUND OF THE INVENTION

Industries which utilize automated production techniques, such as the assembly line production method employed by the automobile industry, utilize numerous transfer systems for transferring articles or workpieces between adjacent production machines or between adjacent working stations on a single machine. These transfer systems have conventionally been mounted directly on the production machine and normally employ oscillating or reciprocating shuttle for moving the workpieces. Many different types of transfer systems have been utilized for this purpose, such as mechanical, electro-mechanical and hydraulic-mechanical units. All of these known transfer systems have, to the best of our knowledge, possessed a common disadvantage in that the transfer system, due to the fact that it must be provided with its own power or driving unit, has thus been substantially large and bulky. Since the space which is available around or on a production machine, such as a multiple-spindle drilling machine, is severely limited, the known transfer systems have thus greatly restricted the desired utilization of this available space. Further, in some instances, the size of the known transfer systems has prevented their utilization in many situations where use of same is desired or, in the alternative, has required that a smaller and less desirable transfer system be utilized which does not result in the optimum or most efficient handling and transferring of the workpieces.

In evaluating a transfer system for use in conjunction with a production machine, it has generally been concluded that the transfer system must necessarily be mounted directly on or adjacent the production machine, and this thus severely restricts the size of the usable transfer system in view of the limited available space. At the same time, the transfer system must be capable of permitting efficient and repetitive transfer of articles or workpieces between adjacent stations, with the required time for accomplishing each transfer cycle or operation being extremely small, such as in the order of several seconds. Still further, it is desired that the transfer operation be controlled so as to minimize the jerking or impact forces which are imposed not only on the transfer system, but also on the workpieces. That is, the workpieces must be picked up from a stationary position and accelerated to a high speed and then immediately decelerated and brought to a stationary condition at a new location, which movement of the workpiece must take place in an extremely short period of time and yet displace the workpiece over a substantial distance which may be in the order of several feet, without imposing severe jerks or acceleration forces on either the workpiece or the transfer system. In addition to the above, the transfer system should be of minimum cost and must be possessed of substantial durability and reliability since these systems are utilized repetitively for long periods of time and are often exposed to substantial abuse during conventional assembly line production techniques. While numerous transfer systems are presently available and are being commercially utilized, nevertheless most of these systems fail to meet the criteria previously mentioned, and thus possess features or characteristics which are less than optimum.

Accordingly, it is an object of the present invention to provide an improved transfer system which overcomes many of the disadvantages associated with the known systems, and which more closely meets the desired criteria for systems of this type as explained above. More specifically, it is an object of this invention to provide:

1. A transfer system, as aforesaid, which employs a transfer mechanism positioned on or directly adjacent the production machine, the transfer mechanism utilizing a conventional hydraulic driving device such as a pressure cylinder, and which also employs a hydraulic drive unit located remotely from the production machine and the transfer mechanism mounted thereon, whereby only the transfer mechanism needs to be located in the direct vicinity of the production machine permitting the size of this transfer mechanism to be substantially minimized so that valuable space adjacent to or on the production machine is not taken up or interfered with by the transfer system.

2. A system, as aforesaid, wherein the remote hydraulic driving unit employs a mechanical mechanism for driving a pumping cylinder, the latter in turn being connected through conduits with the hydraulic drive of the transfer mechanism, whereby the mechanical drive can be utilized to provide the desired motion pattern to the pumping cylinder, which in turn transmits this desired motion pattern to the hydraulic drive of the transfer mechanism.

3. A system, as aforesaid, wherein the mechanical drive comprises a cycloidal drive which permits the acceleration and deceleration of the pumping cylinder and of the transfer mechanism to gradually increase from or decrease toward zero during the respective starting and stopping of the workpiece during performance of a transfer operation, thereby avoiding the imposition of jerking and large acceleration forces on both the workpiece and the transfer system. This cycloidal mechanical drive also provides a controlled motion pattern for the workpiece which, in addition to avoiding sudden and abrupt changes in acceleration, particularly on starting and stopping, also provides a motion pattern which enables the transfer operation to be carried out during an extremely small time interval so as to enable the utilization of a high and efficient production rate.

4. A system, as aforesaid, which utilizes a hydraulic cylinder for driving the cycloidal mechanical drive, which cylinder itself results in zero acceleration at the instant of startup and stopping, with the acceleration rapidly increasing and decreasing during the respective starting and stopping of the cylinder, with the movement of the cylinder being of a fairly constant velocity over a major portion of the stroke thereof, whereby this velocity and acceleration pattern when superimposed with those of the cycloidal mechanical drive accordingly result in a very desirable motion pattern for the transfer mechanism while avoiding the imposition of substantially instantaneously large velocities and accelerations at the instant of starting or stopping.

5. A system, as aforesaid, wherein the pumping cylinder associated with the remote hydraulic driving unit employs an elongated stationary piston rod having an intermediate piston fixed thereto and surrounded by an axially slidable cylinder housing, which cylinder housing is in turn drivingly controlled by the cycloidal mechanical drive, which latter drive employs a slide unit slidably guided on a pair of spaced stationary guide rails one of which has a stationary gear rack associated therewith, which slide additionally partially slidably supports and guidably controls the slidable movement of the pumping cylinder housing.

6. A system, as aforesaid, wherein the pumping cylinder, the cycloidal mechanical drive and the driving cylinder are all disposed in adjacent side-by-side relationship so as to form a unitized assembly of minimum size which can be suitably positioned at any desired remote location and interconnected to the hydraulic driving unit associated with the transfer mechanism, as by means of underground or overhead conduits.

7. A system, as aforesaid, which is of minimum structural and operational complexity, which can be manufactured efficiently and economically, which is durable and dependable in operation, and which results in a highly desirable motion pattern for permitting optimum and efficient repetitive transfer of articles at a high rate.

Other objects and purposes of the invention will be apparent to persons familiar with systems of this general type upon reading the following specification and inspecting the accompanying drawings.

Figure 1:
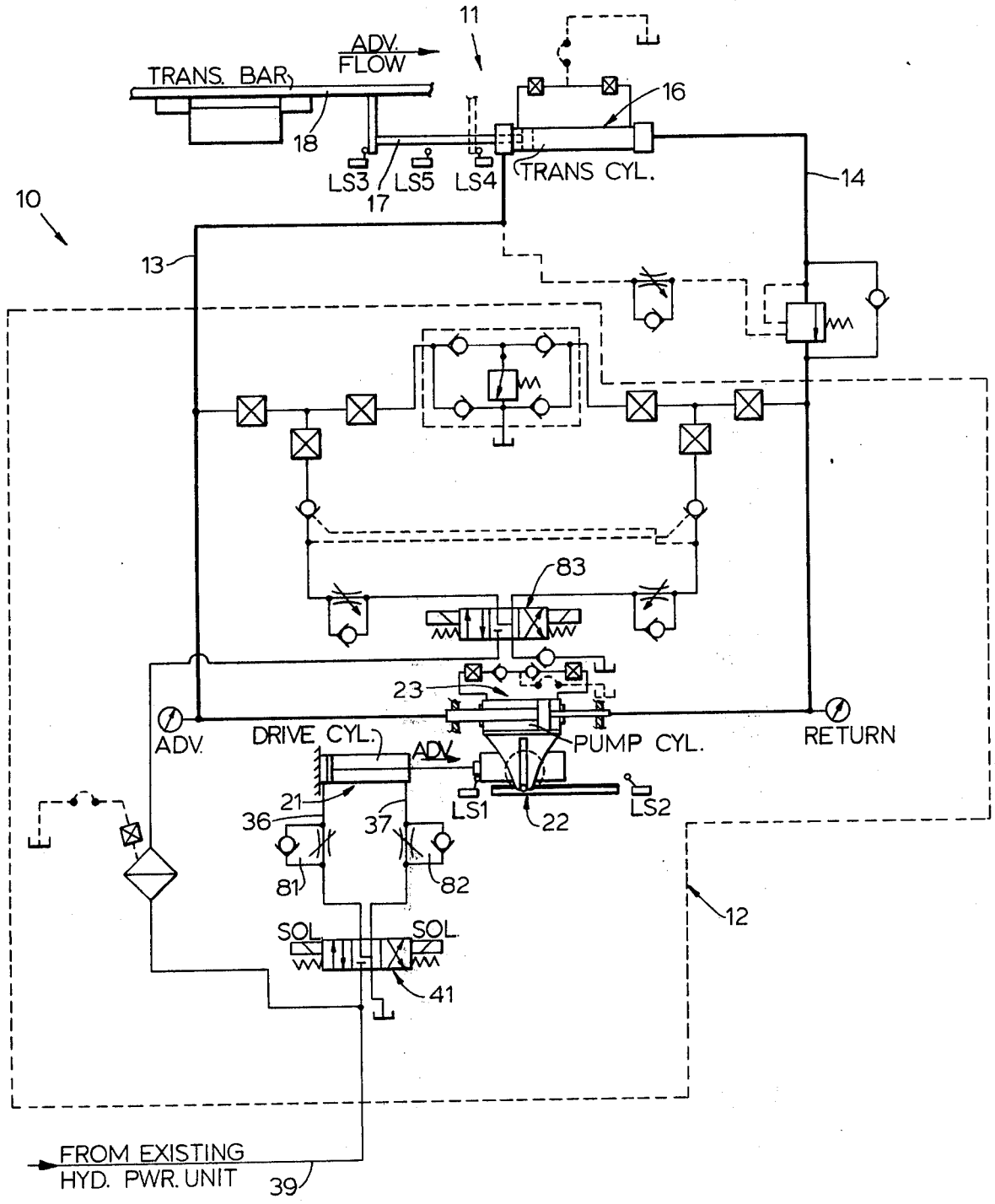
FIG. 1, diagrammatically illustrates the overall transfer system of the present invention, and the hydraulic circuitry for controlling same.

Certain terminology will be used in the folllowing description for convenience in reference only and will not be limiting. For example, the words "upwardly", "downwardly", "rightwardly" and "leftwardly" will refer to directions in the drawings to which reference is made. The word "forwardly" will refer to the direction of movement of the transfer system, and the component parts thereof, which results in the advancing movement of the workpiece from one station to another, with the word "rearwardly" being used to designate the return movement of the system to its original position. The words "inwardly" and "outwardly" will respectively refer to directions toward and away from the geometric center of the system and designated parts thereof. Said terminology will include the words specifically mentioned, derivatives thereof and words of similar import.

SUMMARY OF THE INVENTION

The objects and purposes of this invention are met by providing a transfer system having a transfer mechanism which is located directly on or adjacent the production machine. The transfer mechanism comprises a reciprocating workpiece shuttle driven by a hydraulic driving unit, specifically a hydraulic transfer cylinder. The latter is connected to a remote hyraulic cycloidal drive unit by long conduits which are normally positioned overhead. The remote hydraulic cycloidal drive unit employs a pumping cylinder having an elongated stationary piston rod on which the cylinder housing is slidably supported, with the pressure fluid from the pumping cylinder being supplied through the conduits to the transfer cylinder. The housing of the pumping cylinder is reciprocated by a crank associated with a cycloidal mechanical drive. This crank is connected to and rotates with a gear which is rotatably supported on a slide and reacts with a stationary rack so that reciprocation of the slide causes alternate rotation of the gear. The slide of the cycloidal mechanical drive is in turn reciprocated by a hyraulic drive cylinder which is disposed adjacent and parallel to both the pumping cylinder and the slide of the mechanical drive.

DETAILED DESCRIPTION

FIG. 1 diagrammatically illustrates a transfer system 10 according to the present invention. This sytem includes a fluid-actuated transfer mechanism 11 which is disposed on or directly adjacent a production machine. The transfer mechanism is activated by a hydraulic drive unit 12 which is disposed at a remote location from the transfer mechanism and is connected thereto by conduits 13 and 14.

The transfer mechanism 11 includes a hydraulically-actuated drive device 16 which may comprise a reversible hydraulic motor or, as in the illustrated embodiment, comprises a double-acting hydraulic cylinder. This cylinder 16, hereinafter referred to as the transfer cylinder, has the housing thereof stationarily mounted on or adjacent the production machine, and the piston rod 17 thereof slidably projects outwardly of the housing and is connected to a reciprocating shuttle or transfer bar 18, which bar is normally associated with a pair of guide rails for permitting workpieces or objects to be unidirectionally slidably displaced from one working station to the next during each reciprocating cycle of the transfer bar.

The hydraulic drive unit 12 is normally positioned at some remote location relative to the production machine so as to not interfere with the available space therearound, with the hydraulic pressure fluid being supplied to and returned from the transfer mechanism 11 by the conduits 13 and 14, which conduits may be easily run overhead so as to not interfere with the space around the accessibility to the production machine. In addition, the hydraulic drive unit 12, due to its remote location, can thus be positioned on any noncritical floor area whereby routine service and maintenance of this unit can be easily carried out.

As illustrated in FIG. 1, this unit 12 is formed by three main assemblies which are drivingly connected in series. These three assemblies include a driving assembly which in the illustrated embodiment comprises a double-acting hydraulic drive cylinder 21 which is activated by hydraulic pressure fluid from an external source, which drive cylinder in turn drives a mechanical drive assembly 22 which is preferably a cycloidal drive mechanism. The mechanical drive assembly 22 in turn drives a pump assembly 23 which is formed as a double-acting hydraulic pump cylinder, the latter being interconnected to the transfer cylinder 16 by the conduits 13 and 14 so as to control the flow of fluid therebetween.

Figure 2:
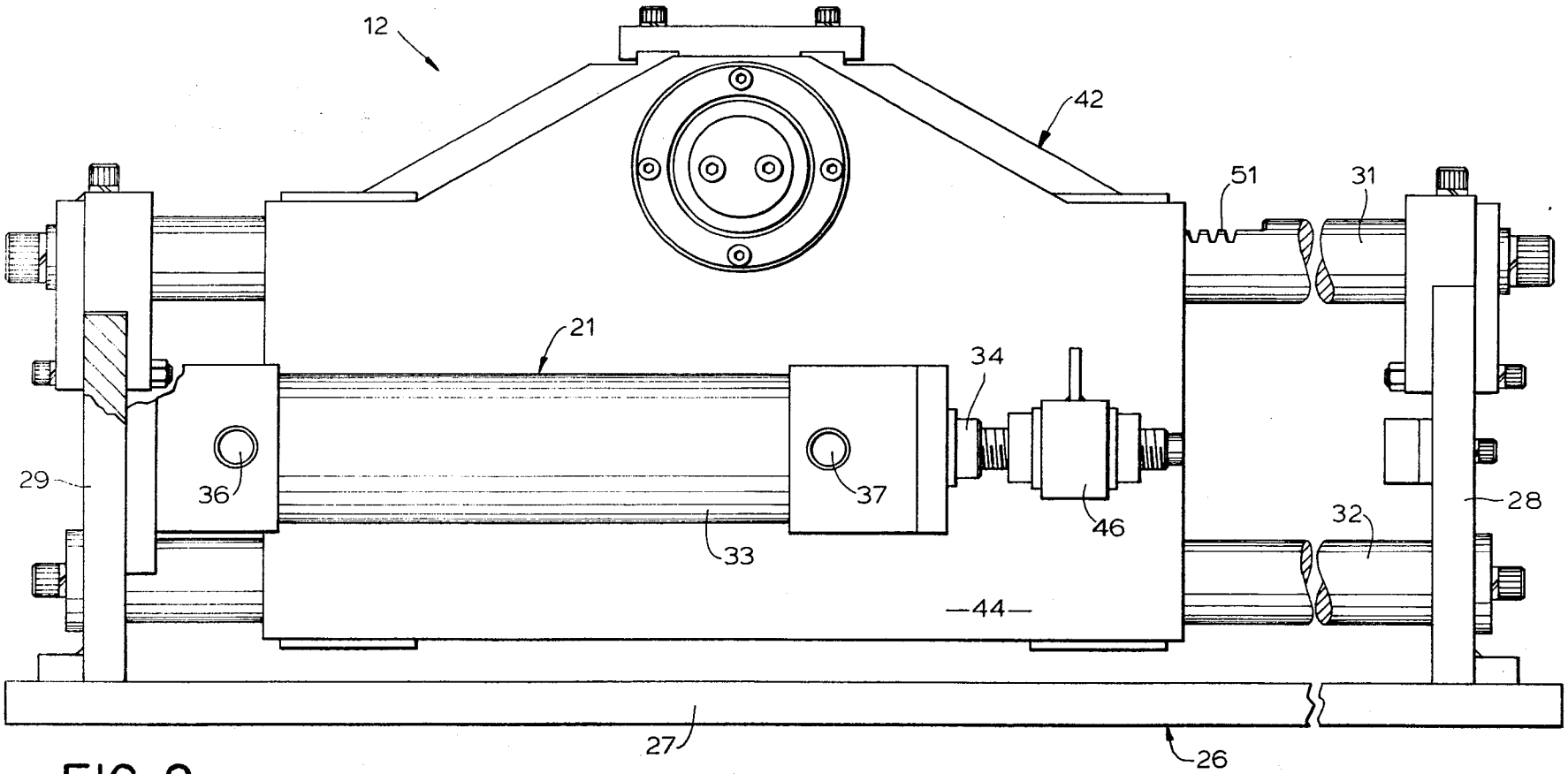
FIG. 2 is a side elevational view of the hydraulic cycloidal drive unit.
Figure 3:
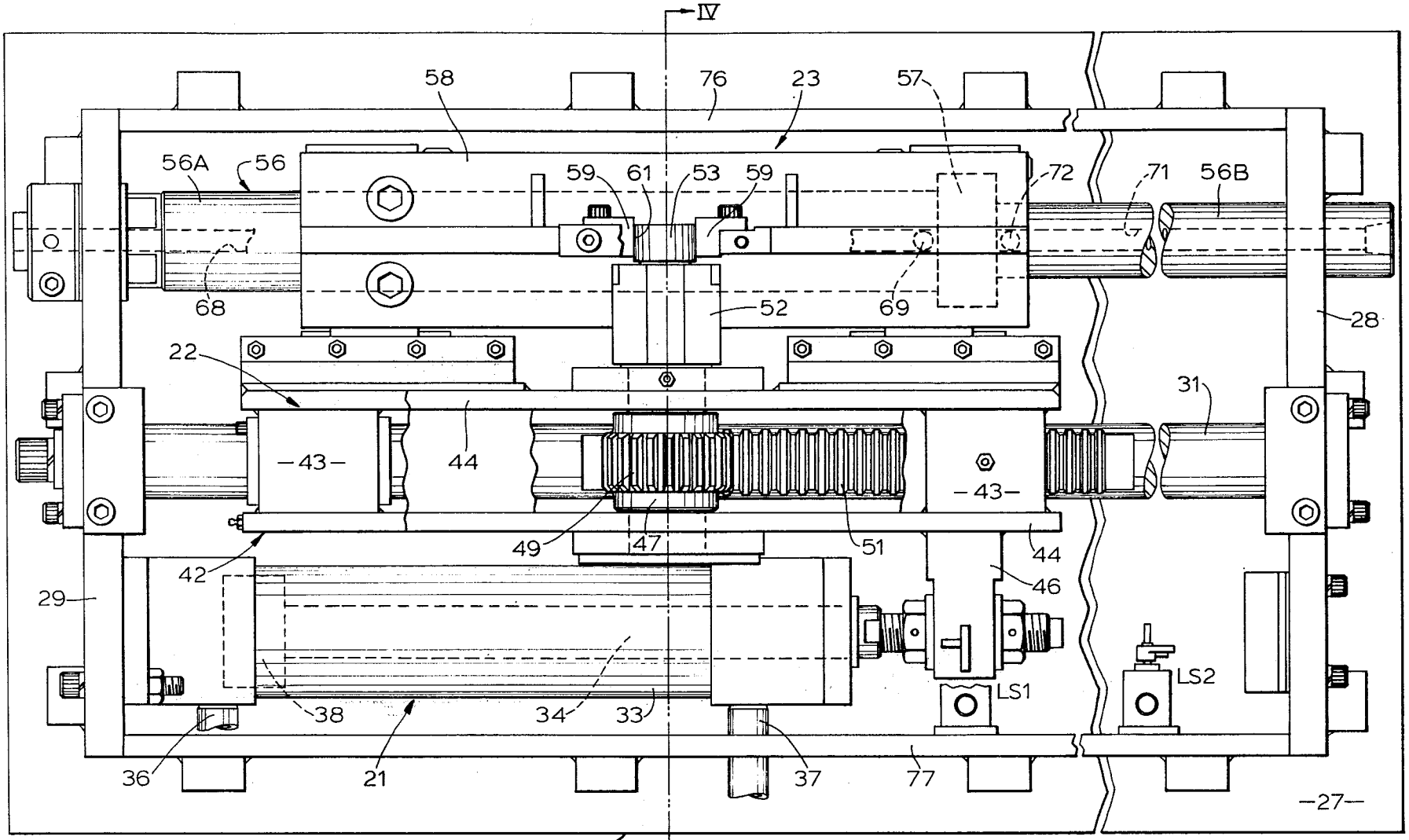
FIG. 3 is a top view of the unit illustrated in FIG. 2.
Figure 4:
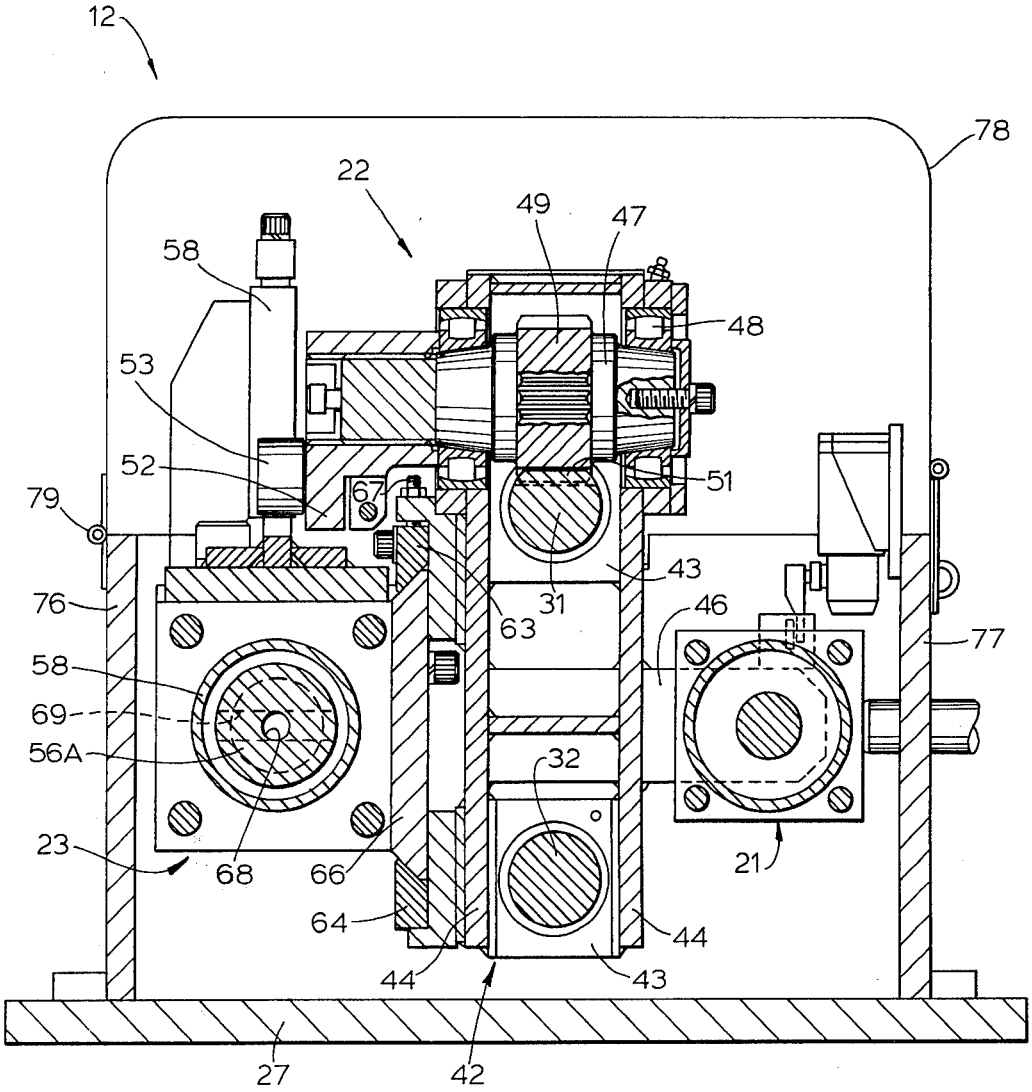
FIG. 4 is a cross-sectional view taken along line IV—IV in FIG. 3.

As illustrated in greater detail by FIGS. 2–4, the hydraulic drive unit 12 includes a frame 26 on which the assemblies 21, 22 and 23 are supported. This frame 26 is of an upwardly opening box-shaped configuration and includes a base plate 27 to which are secured a pair of upstanding end plates 28 and 29. A pair of substantially parallel, horizontally extending guide rods 31 and 32 extend between and are fixedly connected to the end plates. These guide rods 31 and 32 are vertically spaced one above the other and are normally of cylindrical configuration.

The drive cylinder 21 has the housing 33 thereof fixed to and projecting horizontally from the end plate 29, so that the reciprocal sliding piston rod 34 thus projects outwardly toward the opposite end plate 28. The opposite ends of cylindrical 21 are connected to conduits 36 and 37 which supply fluid to or from the chambers located on the opposite sides of the drive piston 38. Pressure fluid is supplied from a main pressure source (not shown) through a supply conduit 39 (FIG. 1) and then through a conventional solenoid-controlled spool valve 41 for permitting the pressure fluid to be alternately supplied to and discharged from the opposite ends of the drive cylinder 21 via the conduits 36 and 37. A pair of conventional limit switches LS1 and LS2 coact with the free end of the piston rod 34 for determining the limits of the stroke thereof.

Considering now the cycloidal drive mechanism 22, same includes a slide unit 42 supported for horizontal reciprocating movement on the upper and lower guide rods 31 and 32. This slide unit is formed by central slide blocks 43 which are slidably supported on the guide rods and are rigidly joined together by a pair of side plates 44 located on opposite sides of the guide rods. The slide unit 42 is fixedly and rigidly connected to the piston rod 34 of the drive cylinder 21 so as to be synchronously movable therewith, and for this purpose a connecting member 46 is rigidly connected between the free end of the piston rod 34 and the adjacent side plate 44.

The slide unit 42 has a shaft 47 rotatably supported on and extending between the side plates 44 so that the rotational axis of this shaft thus extends perpendicular to the direction of movement of the slide unit. This shaft 47, which is rotatably supported by bearings 48, has a conventional gear 49 nonrotatably secured thereto and disposed for meshing engagement with a stationary gear rack 51 which is formed in the upper side of the upper guide rod 31.

One end of shaft 47 has a radial crank 52 fixedly secured thereto, which crank has a roller-supporting crank pin 53 adjacent the radially outer end thereof. This crank pin 53 is radially spaced from the rotational axis of shaft 47 by a radial distance equal to the radius of the pitch circle of gear 49, so as to result in cycloidal motion as explained hereinafter.

The pumping cylinder 23 is positioned directly adjacent the slide unit 42 and includes an elongated piston rod 56 which extends parallel to the guide rods 31 and 32 and is rigidly supported on and between the end plates 28 and 29. This piston rod has a piston 57 fixedly associated therewith intermediate the ends of the rod, and the rod has portions 56A and 56B disposed on opposite sides of the piston which are of different diameters. A hollow cylinder housing 58 of substantially conventional construction is positioned in slidable surrounding relationship to the piston 57 and is interconnected to the cycloidal drive mechanism 22, whereby the cylinder housing 58 is thus linearly reciprocably movable. For this purpose, the cylinder housing has a guide structure fixed to and projecting upwardly from the top wall thereof, which guide structue includes a pair of upwardly projecting parallel guide rails 59 which define a narrow vertically elongated slot 61 therebetween, which slot confines therein the crank roller 53.

To permit slidable movement of the pumping cylinder housing 58 while preventing rotation thereof about the piston, the cylinder housing 58 is additionally slidably and guidably supported on the slide unit 42. As illustrated in FIGS. 3 and 4, one of the side plates 44 has a pair of guide units positioned adjacent the opposite ends of the side plate, with each guide unit including upper and lower guide rails 63 and 64, respectively. These guide rails define a dovetail-type slot for slidably receiving and confining a tapered slide shoe 66 which is secured to the side of the cylinder housing 58. The cylinder housing is thus slidably supported on and guided by the slide unit 42. In addition, the upper guide rail 63 is preferably vertically adjustable, as by a screw 67, so as to permit a proper slidable fit with the shoe 66.

The stationary piston rod portion 56A has a central passage 68 extending coaxially therethrough and terminating in a discharge port 69 which is disposed directly adjacent piston 57 and communicates with the chamber located on one side of the piston 57. A similar passage 71 extends coaxially through the other piston rod portion 56B and also terminates in a port 72 which communicates with the chamber on the opposite side of the piston. These passages 68 and 71 are connected to the conduits 13 and 14, respectively.

The frame 26 for the unit 12, in addition to the base plate 27 and end plates 28–29, also includes a pair of substantially parallel side plates 76 and 77 which project upwardly from the base plate 27 and extend between and are rigidly connected to the end plates 28–29. The side and end plates thus effectively form an upwardly opening box in which the assemblies 21, 22 and 23 are positioned, and this box is closed by a suitable cover 78 which is hinged at 79 to the side plate 76. This thus results in the hydraulic drive unit 21 being totally closed.

OPERATION

The operation of the present invention will be briefly described to insure a complete understanding thereof.

The transfer system 10, at the beginning of a transfer cycle, is in the initial position illustrated by FIGS. 1–4. In this position, the drive cylinder 21 is fully retracted so that the piston rod thereof is substantially in engagement with the rear limit switch LS1, and the crank 52 extends substantially vertically in parallel relationship to the elongated direction of the slot 61 so that the crank roller 53 is thus disposed adjacent the lowermost end of the slot.

To activate the transfer system, a suitable control signal is supplied from the production machine to the control valve 41 causing energization of the left-hand solenoid in FIG. 1 and rightward shifting of the central valve so that pressure fluid is supplied from conduit 39 through the valve into conduit 36, thereby causing the drive cylinder 21 to advance or extend until contacting the opposite stroke limit as defined by the limit switch LS2. This extension of the piston rod 34 causes an identical slidable displacement of the slide unit 42, which carries the gear 49 therewith. The gear, by reacting with the stationary gear rack 51, is thus caused to rotate in proportion to the slidable displacement of the slide unit 42 during the extension of the drive cylinder 21. The stroke length of the cylinder 21, and the identical slidable displacement of the slide unit 42, is such as to cause substantially one complete revolution (360°) of the gear 49 about its axis, thereby causing a corresponding revolution of the crank pin 53. The slidable displacement of the slide unit 42, coupled with the superimposed rotation of the crank pin 53, results in a slidable displacement of the pumping cylinder housing 58 due to the confinement of the crank roller 53 within the slot 61. While the overall stroke length of the cylinder 58 is identical to that of the slide unit 42, nevertheless the motion pattern of the cylinder 58 is substantially different from that of the slide unit 42 due to the interconnection therebetween of the rotating crank 53 and its confinement within the elongated slot 61. The cylinder housing 58 thus moves with a cycloidal-type motion and accordingly has a very gradual change in acceleration and velocity at the ends of its stroke. The different motions between the cylinder housing 58 and the slide unit 42 are additionally facilitated by the slidable guide structure which is provided between these units by means of the guide rails 63–64 and the associated guide shoe 66.

During the forward advancing movement (rightward movement in FIG. 3) of the cylinder housing 58 caused by the rightward advancing movement of the slide unit 42, the pressure fluid in the rearward or leftward chamber of the cylinder housing is pressurized and forced through the port 69 into the central passage 68 and then through the conduit 13 so as to be supplied to the leftward end of the transfer cylinder 16. This thus causes a contraction of the transfer cylinder so that the shuttle or transfer bar 18 is thus moved (rightwardly in FIG. 1) through its preselected stroke to cause advancing of the workpiece. This advancing stroke normally occurs in a very short time interval, such as in the order of one and one-half seconds. Further, since the transfer bar often moves extremely heavy loads, which may be in the order of several thousand pounds, the inertia of this heavy load tends to keep the load moving after the bar 18 is rapidly accelerated tc a high velocity. Thus, during approximately the last half of the forward advancing stroke of the transfer cylinder 16, the load itself tends to drive backwardly through the hydraulic unit 12 in that the load pressurizes the fluid on the right side of the transfer cylinder 16 and forces same through conduit 14 backwardly into the pumping cylinder, thereby tending to continually drive the unit in its forward direction. For this purpose, the conduits 36 and 37 associated with the drive cylinder 21 have suitable flow control valves 81 and 82 associated therewith. These valves each control the maximum discharge flow rate through the respective conduits and hence thus limit the discharge of pressure fluid from the unit, thereby preventing the load from driving the assemblies of the unit 12.

When the extension of piston rod 34 causes it to contact limit switch LS2, the control valve 41 is shifted so as to thereby supply pressure fluid from conduit 39 through conduit 37 into the opposite end of the drive cylinder 21, thereby retracting the drive cylinder backwardly into its original position. This accordingly causes an equal retraction of the slide unit 42, and a corresponding retraction of the cylinder housing 58. During this retraction (leftward) movement of the cylinder housing 58, the fluid in the rightward chamber of the housing is pressurized and supplied through passage 71 and conduit 14 to the rightward end of the transfer cylinder 16, thereby extending same so as to return the transfer bar 18 to its original position, whereby the overall transfer system is thus in condition to permit initiation of a new transfer cycle.

As illustrated in FIG. 1, suitable limit switches LS3 and LS4 are also provided for association with the transfer bar 18 to determine the limits of its reciprocating travel. These limit switches thus properly indicate whether the transfer bar is being properly reciprocated. If for some reason the transfer bar 18 is not moved all the way to its desired end position, as indicated by the respective limit switch, even though the drive cylinder has undergone its full stroke, then a suitable signal (such as from the intermediate limit switch LS5) is supplied to a further solenoid-controlled spool valve 83 which is then suitably opened so as to permit pressure fluid to be supplied directly from the main conduit 39 through the valve 83 to the appropriate one of the conduits 13 or 14 so as to insure completion of the transfer cycle.

The present invention thus is advantageous in that it permits the initial acceleration and velocity of the transfer bar 18, and the workpiece being moved thereby, to pick up very gradually from zero due to the provision of a cycloidal drive mechanism and its cooperation with the pumping cylinder. While this permits a very gradual velocity and acceleration pickup or decrease at the starting and stopping points of the stroke, nevertheless this still permits a desired motion pattern which enables a very rapid intermediate velocity to be developed so that the transfer can take place in an extremely short time interval.

By providing the cylinder rod portions 56A and 56B of different diameters, these rod portions thus compensate for the different fluid volumes which exist on opposite sides of the piston disposed within the transfer cylinder 16. A further advantageous result of utilizing a closed circuit formed by the pumping cylinder 23 and the transfer cylinder 16 results from the fact that these cylinders can be of different sizes and strokes. For example, the transfer cylinder often requires a relatively long stroke although the cylinder can be of small diameter in order to develop the necessary driving force. On the other hand, since it is desirable to maintain the hydraulic drive unit 12 as small as possible, the pumping cylinder 23 can be of a stroke substantially less than that of the transfer cylinder, although the pumping cylinder must necessarily be of substantially larger diameter so as to result in equal oil volumes in the two cylinders.

Further, the hydraulic drive unit 12 can be positioned a substantial distance from the production machine, and hence a substantial distance from the transfer mechanism 11 inasmuch as the connecting conduits 13 and 14 can extend through substantial distances. These conduits may be run either under the floor or overhead so as to create no interference with the accessibility to the production machine or its associated equipment. This thus greatly facilitates the mounting and adaptation of the transfer system to a production machine, and particularly to an existing machine.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or priviledge is claimed are defined as follows:

1. In a transfer system for use in association with a production machine to permit a workpiece to be transferred from one working station to another, said system comprising:

a transfer mechanism mounted on or directly adjacent the production machine and including oscillating shuttle means movable back and forth between first and second locations for effecting transfer of a workpiece therebetween, and fluid power means connected to said shuttle means for effecting the oscillating movement thereof;

a fluid drive unit for supplying pressure fluid to and from the transfer mechanism to effect the oscillating thereof, said fluid drive unit being remotely located relative to said transfer mechanism and including (1) a frame, (2) double-acting fluid pumping cylinder means mounted on said frame and having piston means and cylinder housing means slidably supported for relative displacement with respect to one another, (3) mechanical drive means drivingly connected to said pumping cylinder means for effecting relative slidable displacement between said cylinder housing means and said piston means, said mechanical drive means including a cycloidal drive mechanism having a linearly reciprocal slide, a gear rotatably supported on said slide and disposed in rolling meshing engagement with a stationary gear rack, and a crank drivingly connected to said gear and disposed in driving engagement with said pumping cylinder means, (4) drive motor means connected to said slide for causing driving reciprocation thereof; and conduit means connected between said fluid power means and said pumping cylinder means for forming a closed fluid pressure system.

2. A system according to claim 1, wherein said fluid power means comprises a double-acting fluid pressure transfer cylinder, and wherein said drive motor means also comprises a double-acting fluid pressure cylinder.

3. A system according to claim 2, wherein said pumping cylinder means has an elongated piston rod which is stationarily supported on said frame and has a piston fixed thereto intermediate the ends thereof, said cylinder housing means surrounding and being slidably supported on said piston and said piston rod, and said crank being connected to said cylinder housing means for effecting reciprocating movement thereof.

4. A system according to claim 3, wherein said piston rod has a pair of fluid passages formed therein and extending coaxially thereof from opposite ends of said rod, said passages terminating in ports which communicate with chambers formed in said cylinder housing means on opposite sides of said piston, and said pairs of passages being connected to said conduits, said conduits in turn being connected to the opposite ends of said double-acting transfer cylinder.

5. A system according to claim 4, wherein said frame includes a pair of parallel stationary guide rods, said slide being mounted on and slidably supported on said pair of guide rods, one of said guide rods having said gear rack formed thereon and positioned in meshing engagement with said gear, and said cylinder housing means having a guide structure fixedly associated therewith and positioned in slidable guiding engagement with a cooperating guide structure fixed to said slide.

6. In a transfer system for use with a production machine to move workpieces from a first work station to a second work station, said system comprising:

a hydraulic drive unit located at a remote location with respect to said production machine, said drive unit including (a) a frame, (b) a double-acting hydraulic drive cylinder having a cylinder housing stationarily mounted on said frame and a piston rod slidably movable through a preselected stroke, (c) a cycloidal mechanical drive assembly connected to and driven by said drive cylinder, said mechanical drive assembly including a slide unit slidably supported on said frame and fixedly connected to said piston rod for simultaneous reciprocating movement therewith, a gear mounted on and rotatably supported with respect to said slide unit, said gear being disposed in meshing engagement with a gear rack which is stationarily positioned relative to said frame, and a crank fixed to said gear for rotation therewith, said crank having a crank pin radially spaced from the rotational axis of said gear by a distance equal to the radius of the gear pitch circle, (d) double-acting hydraulic pumping cylinder means connected to and driven by said crank pin, said pumping cylinder means including an elongated cylinder rod stationarily mounted on said frame and having an intermediate stationary piston, and a pumping cylinder housing surrounding said piston and said piston rod and being slidably supported thereon, said pumping cylinder housing being slidably supported for slidable displacement in a direction parallel with the direction of movement of said slide unit, said cylinder housing also having guide means fixed thereto and defining an elongated slot which extends perpendicular to said direction of movement, said elongated slot confining therein said crank pin, (e) said drive cylinder having a stroke of preselected length for causing said gear to undergo only a single complete revolution during each forward and each return stroke of the drive piston;

a transfer mechanism for effecting movement of a workpiece from said first work station to said second work station, said transfer mechanism being mounted on or directly adjacent said production machine and including a reciprocating shuttle for engaging and moving the workpiece, and a double-acting hydraulic transfer cylinder connected to said shuttle for effecting reciprocation thereof; and first and second elongated conduits connected between said transfer cylinder and said pumping cylinder means for permitting the transfer of hydraulic pressure fluid therebetween, said conduit means in conjunction with said transfer cylinder and said pumping cylinder means defining a closed hydraulic system.

7. A system according to claim 6, wherein said frame includes a pair of spaced guide rods having said slide unit slidably supported thereon, one of said guide rods having said stationary gear rack fixedly associated therewith, said slide unit also having an elongated guide structure fixed thereto and extending parallel to said rods, means fixedly associated with said pumping cylinder housing and disposed in slidable guiding engagement with said guide structure, and the piston rod of said pumping cylinder means extending parallel to said guide rods and having first and second fluid passages formed coaxially in opposite ends thereof, said first and second passages being connected to said first and second conduits respectively.

* * * * *